US011052458B2

(12) United States Patent
Bird et al.

(10) Patent No.: US 11,052,458 B2
(45) Date of Patent: Jul. 6, 2021

(54) IN-SITU SELECTIVE REINFORCEMENT OF NEAR-NET-SHAPED FORMED STRUCTURES

(71) Applicant: U.S.A. as represented by the Administrator of the National Aeronautics and Space Administration, Washington, DC (US)

(72) Inventors: Richard Keith Bird, Grafton, VA (US); Joel A. Alexa, Hampton, VA (US); Peter L. Messick, Poquoson, VA (US); Marcia S. Domack, Carrollton, VA (US); John A. Wagner, Newport News, VA (US)

(73) Assignee: UNITED STATES OF AMERICA AS REPRESENTED BY THE ADMINISTRATOR OF NASA, Washington, DC (US)

( * ) Notice: Subject to any disclaimer, the term of this patent is extended or adjusted under 35 U.S.C. 154(b) by 997 days.

(21) Appl. No.: 15/040,528

(22) Filed: Feb. 10, 2016

(65) Prior Publication Data

US 2016/0228947 A1 Aug. 11, 2016

Related U.S. Application Data

(60) Provisional application No. 62/114,234, filed on Feb. 10, 2015.

(51) Int. Cl.
*B22D 19/02* (2006.01)
*B22D 13/00* (2006.01)
(Continued)

(52) U.S. Cl.
CPC ..... *B22D 19/02* (2013.01); *B21D 22/16* (2013.01); *B21D 26/059* (2013.01);
(Continued)

(58) Field of Classification Search
CPC .. B21D 26/059; B21D 26/053; B21D 35/007; B21D 49/00; B21D 22/16; B21K 25/00;
(Continued)

(56) References Cited

U.S. PATENT DOCUMENTS 4,301,584 A * 11/1981 Dillner ..... B21D 26/053 29/889.71
5,337,803 A * 8/1994 Divecha ..... B22D 13/02 164/100

(Continued)

FOREIGN PATENT DOCUMENTS

WO WO-2015105286 A1 * 7/2015 ..... B21D 53/30

OTHER PUBLICATIONS

Machine Translation of WO 2015/105286 A1 (Year: 2015).*
Farley, Gary L.: "Selective Reinforcement to Enhance Structural Performance of Metallic Compression Panels"; 45th AIAA/ASME/ASCE/AHS/ASC Structures, Structural Dynamics & Materials Conference, Palm Springs, CA, Apr. 19-22, 2004.

(Continued)

*Primary Examiner* — Christopher J Besler
(74) *Attorney, Agent, or Firm* — Shawn P. Gorman; Jennifer L. Riley; Helen M. Galus

(57) ABSTRACT

Various embodiments provide methods in which a metal matrix composite (MMC) material is incorporated into a metallic structure during a one-step near-net-shape structural forming process. Various embodiments provide in-situ selective reinforcement processes in which the MMC may be pre-placed on a forming tool in locations that correspond to specific regions in the metallic structure. Various embodiment near-net-shape structural forming processes may then be executed and result in various embodiment metallic structural components with selectively-reinforced regions that provide enhanced mechanical properties in key locations.

17 Claims, 12 Drawing Sheets

FIG. 2B

(51) Int. Cl.

| | |
|---|---|
| ***B22D 23/00*** | (2006.01) |
| ***B21D 22/16*** | (2006.01) |
| ***B22D 19/14*** | (2006.01) |
| ***B21K 25/00*** | (2006.01) |
| ***B21D 49/00*** | (2006.01) |
| ***B21D 26/059*** | (2011.01) |
| ***B21D 35/00*** | (2006.01) |
| ***B22D 21/00*** | (2006.01) |
| ***B21D 37/01*** | (2006.01) |

(52) U.S. Cl.
CPC ..... *B21D 35/007* (2013.01); *B21D 37/01* (2013.01); *B21D 49/00* (2013.01); *B21K 25/00* (2013.01); *B22D 13/00* (2013.01); *B22D 19/14* (2013.01); *B22D 21/007* (2013.01); *B22D 23/00* (2013.01)

(58) Field of Classification Search
CPC ..... B22D 13/00; B22D 11/007; B22D 19/02; B22D 19/14; B22D 19/16; B22D 23/00
See application file for complete search history.

(56) References Cited

U.S. PATENT DOCUMENTS

| | | | | |
|---|---|---|---|---|
| 2006/0024490 | A1* | 2/2006 | Werner | B22D 19/14 428/323 |
| 2006/0107516 | A1* | 5/2006 | Joseph | C22C 47/00 29/557 |
| 2006/0254744 | A1* | 11/2006 | Gordon | B22D 19/02 164/98 |
| 2008/0107532 | A1* | 5/2008 | Carrier | F01D 5/282 416/213 R |
| 2011/0162521 | A1* | 7/2011 | Takami | B22D 17/10 92/169.1 |
| 2012/0177501 | A1* | 7/2012 | Cairo | C22C 47/20 416/230 |

OTHER PUBLICATIONS

Farley, Gary L.; Newman, John A.; and James, Mark A.: "Selective Reinforcement to Improve Fracture Toughness and Fatigue Crack Growth Resistance of Metallic Structures"; 45th AIAA/ASME/ASCE/AHS/ASC Structures, Structural Dynamics & Materials Conference, Palm Springs, CA, Apr. 19-22, 2004.

Abada, Christopher H.; Farley, Gary L.; and Hyer, Michael W.: "Fracture Response Enhancement of Aluminum Using In-Situ Selective Reinforcement", 47th AIAA/ASME/ASCE/AHS/ASC Structures, Structural Dynamics & Materials Conference, Newport, RI, May 1-4, 2006.

Wagner, John A.; Domack, Marcia S.; and Hoffman, Eric K.: "Recent Advances in Near-Net-Shape Fabrication of Al—Li 2195 Alloy Launch Vehicles"; National Space & Missile Materials Symposium, Keystone, CO, Jun. 2007.

Troeger, Lillianne P.; and Wagner, John A.: "Microstructure and Mechanical Property Characterization of Shear Formed Al—Li 2195 Alloy for Launch Vehicle Applications"; Journal of Materials Processing & Manufacturing Science, vol. 9, 2001.

Irick, Virgil, and Gordon, Brian L.; and Cohen, David: "MetPregTM Metallic Prepregs for the Composites Industry"; SAMPE Journal, Mar./Apr. 2004.

Gordon, Brian L.; and Cohen, David: "Metal Matrix Composite Filament Winding": Composites 2006 Convention and Trade Show, St. Louis, MO, Oct. 18-20, 2006.

"Standard Test Method for Flexural Testing of Polymer Composite Materials," Annual Book of ASTM Standards Designation D7264-07, American Society for Testing and Materials, West Conshohocken, PA.

Aerospace Structural Metals Handbook—vol. 3, Code 3228. Brown, Mindlin, and Ho, eds. 39th Edition, CINDAS/USAF CRDA Handbook operation, Purdue University, West Lafayette, Indiana, 2005.

MetPregTM Metallic Prepregs for the Composites Industry. Data Sheet from Touchstone Research Laboratory, Ltd.

* cited by examiner

300

| Vacuum Hot Press Run No. | Tape Matrix | Tape Dimensions | | Base Plate Dimensions | | | Temp. | Load | Pressure (tape) | Pressure (base plate) | Time | Comments |
|---|---|---|---|---|---|---|---|---|---|---|---|---|
| | | Width | Thick | Length | Width | Thick | | | | | | |
| | | in. | in. | in. | in. | in. | °F | tons | ksi | ksi | min. | |
| VHP-387 | Al 1100 | 0.48 | 0.018 | 2.75 | 1.0 | 0.25 | 930 | 20.6 | --- | 15.0 | 60 | Al-2024 Cover Plate |
| VHP-388 | Al 1100 | 0.48 | 0.018 | 2.75 | 1.0 | 0.25 | 890 | 0.5 | --- | 0.35 | 60 | Al-2024 Cover Plate |
| VHP-391 | Al 1100 | 0.48 | 0.018 | 6.0 | 2.0 | 0.25 | 570 | 90.0 | 60.0 | --- | 15 | Load applied directly to tape surface |

Vacuum Hot Press Processing Parameters For Selectively-Reinforced Al-2219 Panels

FIG. 3

400

| Vacuum Hot Press Run No. | Tape Matrix | Tape Dimensions | | Base Plate Dimensions | | | Temp. | Load | Pressure (tape) | Pressure (base plate) | Time | Comments |
|---|---|---|---|---|---|---|---|---|---|---|---|---|
| | | Width | Thick | Length | Width | Thick | | | | | | |
| | | in. | in. | in. | in. | in. | °F | tons | ksi | ksi | min. | |
| VHP-398 | Al 1100 | 0.375 | 0.018 | 2.5 | 1.0 | 0.185 | 730 | 22.0 | 46.9 | 17.6 | 5 | |
| VHP-399 | Al-2Cu | 0.375 | 0.018 | 2.5 | 1.0 | 0.185 | 710 | 5.2 | 11.1 | 4.2 | 5 | |
| VHP-412 | Al-2Cu | 0.375 | 0.018 | 5.0 | 1.0 | 0.170 | 800 | 40.0 | 10.7 | 4.0 | 5 | Four panels fabricated simultaneously |
| VHP-423 | Al 1100 | 0.48 | 0.018 | 4.6 | 1.0 | 0.170 | 800 | 47.9 | 10.8 | 5.2 | 5 | Four panels fabricated simultaneously |

Vacuum Hot Press Processing Parameters For Selectively-Reinforced Al-2195 Panels

FIG. 4

800

| Fatigue Set | Fatigue Conditions | Cumulative No. of Fatigue Cycles | Post-Fatigue Bending Stiffness (lb/in) | |
|---|---|---|---|---|
| | | | VHP-412-2-MOD (one layer of tape) | VHP-412-2-MOD (one layer of tape) |
| ---------- | Prior to fatigue testing | 0 | 4,010 | 4,827 |
| 1 | 50,000 cycles at $P_{max}$ = 50 lbs | 50,000 | 3,987 | 4,783 |
| 2 | 50,000 cycles at $P_{max}$ = 60 lbs | 100,000 | 4,085 | 4,830 |
| 3 | 50,000 cycles at $P_{max}$ = 70 lbs | 150,000 | 4,048 | 4,927 |
| 4 | 50,000 cycles at $P_{max}$ = 80 lbs | 200,000 | 4,031 | 4,784 |
| 5 | 50,000 cycles at $P_{max}$ = 90 lbs | 250,000 | 4,068 | 5,037 |
| 6 | 50,000 cycles at $P_{max}$ = 100 lbs | 300,000 | ----- | 4,952 |
| 7 | 50,000 cycles at $P_{max}$ = 110 lbs | 350,000 | ----- | 4,933 |
| 8 | 50,000 cycles at $P_{max}$ = 120 lbs | 400,000 | ----- | 4,996 |

Three-point bending fatigue test parameters and stiffness data following sets of 50,000 fatigue cycles at incrementally increasing maximum fatigue loads for selectively-reinforced Al-2195 specimens

FIG. 8

IN-SITU SELECTIVE REINFORCEMENT OF NEAR-NET-SHAPED FORMED STRUCTURES

CROSS REFERENCE TO RELATED APPLICATIONS

This patent application claims the benefit of and priority to U.S. Provisional Patent Application No. 62/114,234 entitled "In-Situ Selective Reinforcement of Near-Net-Shaped Formed Structures" filed Feb. 10, 2015, the contents of which are hereby incorporated by reference in their entirety.

STATEMENT REGARDING FEDERALLY SPONSORED RESEARCH OR DEVELOPMENT

The invention described herein was made in part by employees of the United States Government and may be manufactured and used by or for the Government of the United States of America for governmental purposes without the payment of any royalties thereon or therefore.

BACKGROUND OF THE INVENTION

One current method for enhancing the properties of a structural component, such as a metallic component, in specific areas includes designing and fabricating the component with thicker sections located in the specific areas. As an example, for cylinders with longitudinal stiffeners, the stiffeners would be designed to have greater thickness and/or height to improve strength and stiffness in such a current methods. A drawback of the current method of designing and fabricating the component with thicker sections located in the specific areas is that such a design adds more weight to the component.

Another current practice for selective reinforcement of a structural component, such as a metallic component, is to add reinforcing material after the structural component has been fabricated. The reinforcing material is bonded to the locations that require reinforcement using adhesive bonding, brazing, diffusion bonding, etc. This current selective reinforcement method requires secondary processing of the structural component that may have deleterious effects on its properties. In addition, the strength of the bond between the structural component and reinforcing material can limit the performance enhancement offered by the reinforcement.

BRIEF SUMMARY OF THE INVENTION

Various embodiments provide methods in which a metal matrix composite (MMC) material is incorporated into a metallic structure during a one-step near-net-shape structural forming process. Various embodiments provide in-situ selective reinforcement processes in which the MMC material may be pre-placed on a forming tool in locations that correspond to specific regions in the metallic structure. Various embodiment near-net-shape structural forming processes may then be executed and result in various embodiment metallic structural components with selectively-reinforced regions that provide enhanced mechanical properties in key locations.

These and other features, advantages, and objects of the present invention will be further understood and appreciated by those skilled in the art by reference to the following specification, claims, and appended drawings.

BRIEF DESCRIPTION OF THE SEVERAL VIEWS OF THE DRAWINGS

The accompanying drawings, which are incorporated herein and constitute part of this specification, illustrate exemplary embodiments of the invention, and together with the general description given above and the detailed description given below, serve to explain the features of the invention.

FIG. 3 is a table of panel components and processing parameters for Al-2219 plate experiments.

FIG. 4 is a table of panel components and processing parameters for Al-2195 plate experiments.

FIG. 8 is a table of fatigue test parameters and bending stiffness data measured before and after each set of fatigue cycles for selectively-reinforced Al-2195 specimens.

DETAILED DESCRIPTION OF THE INVENTION

Figure 1:
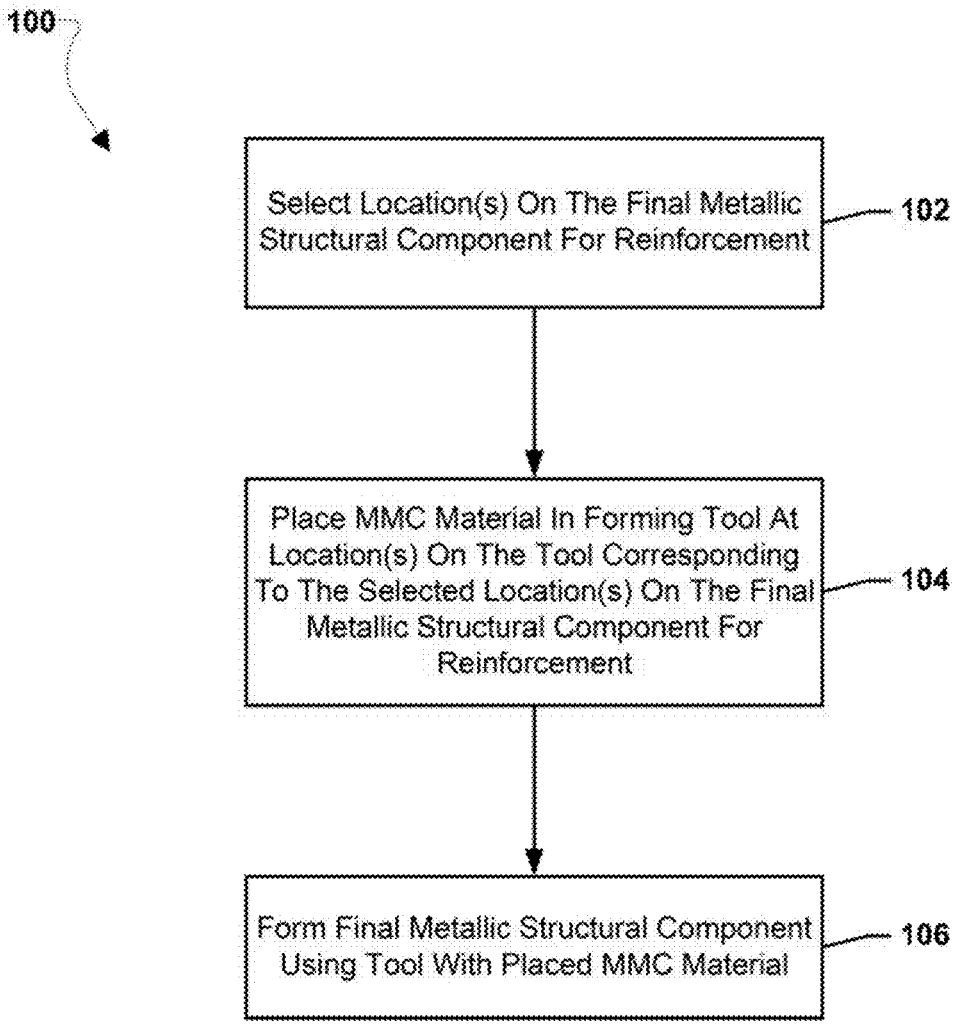
FIG. 1 illustrates an embodiment in-situ selective reinforcement method.

For purposes of description herein, it is to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The word "exemplary" is used herein to mean "serving as an example, instance, or illustration." Any implementation described herein as "exemplary" is not necessarily to be construed as preferred or advantageous over other implementations.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

Various embodiments provide methods in which a metal matrix composite (MMC) material, such as a fiber-reinforced aluminum tape, is incorporated into a metallic structure during a one-step near-net-shape structural forming process. The various embodiments provide in-situ selective reinforcement processes in which a MMC material may be pre-placed on a forming tool in locations that correspond to specific regions in the metallic structure. Various embodiment near-net-shape structural forming processes may then be executed and result in various embodiment metallic structural components with selectively-reinforced regions that provide enhanced mechanical properties in key locations.

In various embodiments, a reinforcing material may be incorporated into a metallic structural component in-situ during the near-net-shape forming process of the metallic structural component. The various embodiments may be applicable to near-net-shape processes for forming metallic structural components that involve forming metal alloy starting stock materials onto a tool. As the metal alloy starting stock material is formed over the tool, the metal alloy starting stock material flows into recesses and around protrusions of the tool to result in a final metallic structural component that has the shape of the tool surface. The various embodiment in-situ selective reinforcement processes may be applicable to any metallic material and any metallic composite material that may form a metallurgical bond with each other.

In the various embodiment in-situ selective reinforcement processes, the MMC material may be strategically pre-placed in locations on the tool that correspond to selected stress-critical regions in the final metallic structural component. As the forming process takes place, the metal alloy starting stock material flows over the tool and metallurgically bonds to the reinforcing material (i.e., the MMC material pre-placed in the tool). Thus, the final metallic structural component incorporates reinforcing material (i.e., the MMC material pre-placed in the tool) in the selected predetermined regions that may need enhanced performance.

The various embodiment in-situ selective reinforcement processes may utilize any type MMC material, such as any fiber reinforced aluminum material. The MMC material may be in any form, such as a tape. The MMC material may be a metallic material (e.g., aluminum, an aluminum alloy, etc.) reinforced with fibers, whiskers (e.g., short fibers), and/or particles, such as ceramic fibers, whiskers, and/or particles (e.g., alumina fibers, whiskers, and/or particles, silicon-carbide fibers, whiskers, and/or particles, etc.). For example the MMC material may be MetPreg™ tape, a fiber-reinforced aluminum material including a commercially-pure aluminum (Al-1100) matrix reinforced with 50 volume percent continuous Nextel™ 610 alumina fibers. As another example, the MMC material may be an aluminum alloy matrix with a percent weight copper (e.g., 2 weight percent copper (Al-2Cu), less than 2 weight percent copper, greater than 2 percent weight copper, etc.). The dimensions of the MMC material (e.g., thickness and/or width, etc.) may vary. As examples, a tape thickness may be less than 0.018 inches, 0.018 inches, from 0.018 inches to 0.180 inches, 0.180 inches, greater than 0.180 inches, etc. and/or a tape width may be less than 0.375 inches wide, from 0.375 inches, from 0.375 inches to 0.45 inches, 0.45 inches, from 0.45 inches to 0.48 inches, 0.48 inches, greater than 0.48 inches, etc.

The various embodiment in-situ selective reinforcement processes may utilize any type starting material to be formed into the final metallic structural component, such as any metal alloy starting stock material. For example, the metal alloy starting stock material may be aluminum, an aluminum alloy (e.g., aluminum alloy 2219-T851, aluminum-lithium alloy 2195-T8, etc.), etc.

The various embodiment in-situ selective reinforcement processes may utilize any one-step near-net-shape structural forming process, such as spin forming, flow forming, forging, cold pressing, etc.

FIG. 1 illustrates an embodiment in-situ selective reinforcement method 100. In step 102 one or more locations on the final metallic structural component may be selected for reinforcement. In step 104 the MMC material may be placed in the forming tool at one or more locations on the tool corresponding to the selected one or more locations on the final metallic structural component for reinforcement. In step 106 the final metallic structural component may be formed using the tool with the placed MMC material.

Figure 2A:
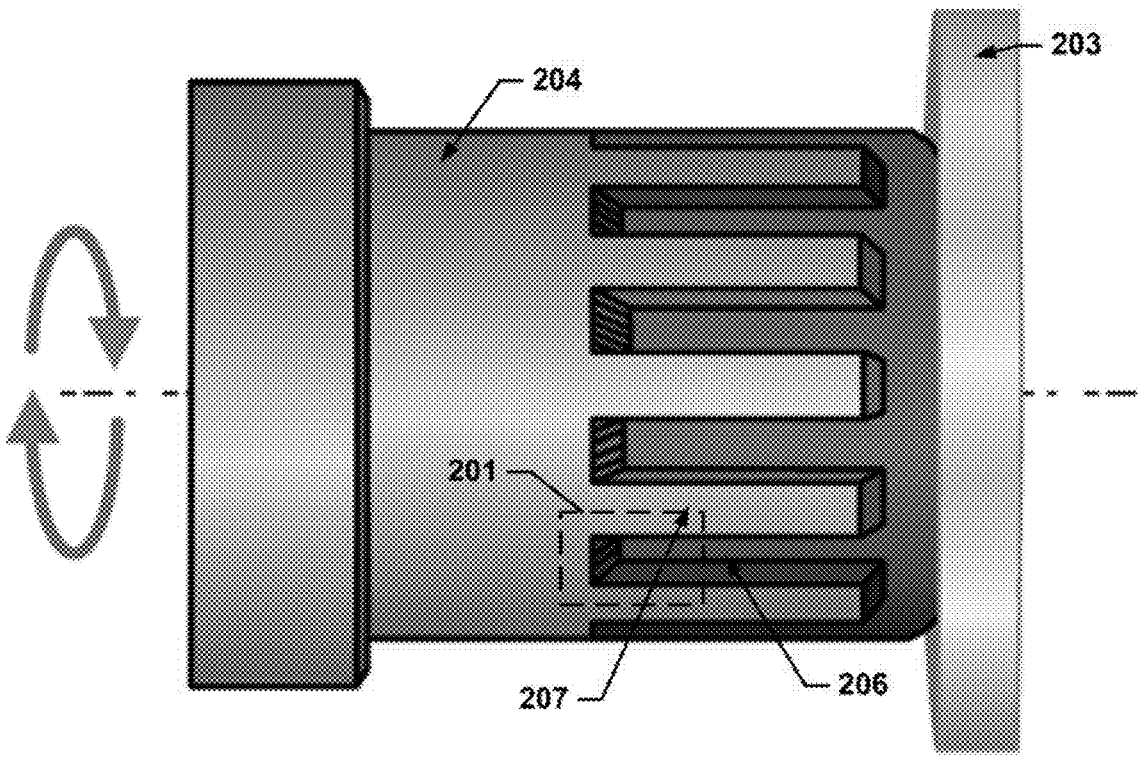
FIG. 2A illustrates a tool and starting material according to an embodiment in-situ selective reinforcement method.
Figure 2B:
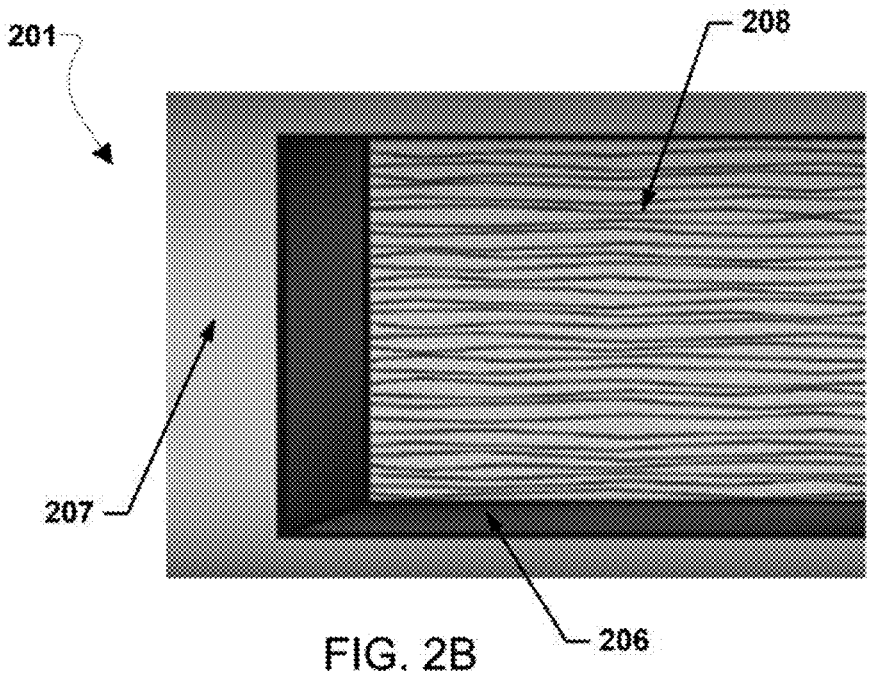
FIG. 2B illustrates a portion of the tool illustrated in FIG. 2A.
Figure 2C:
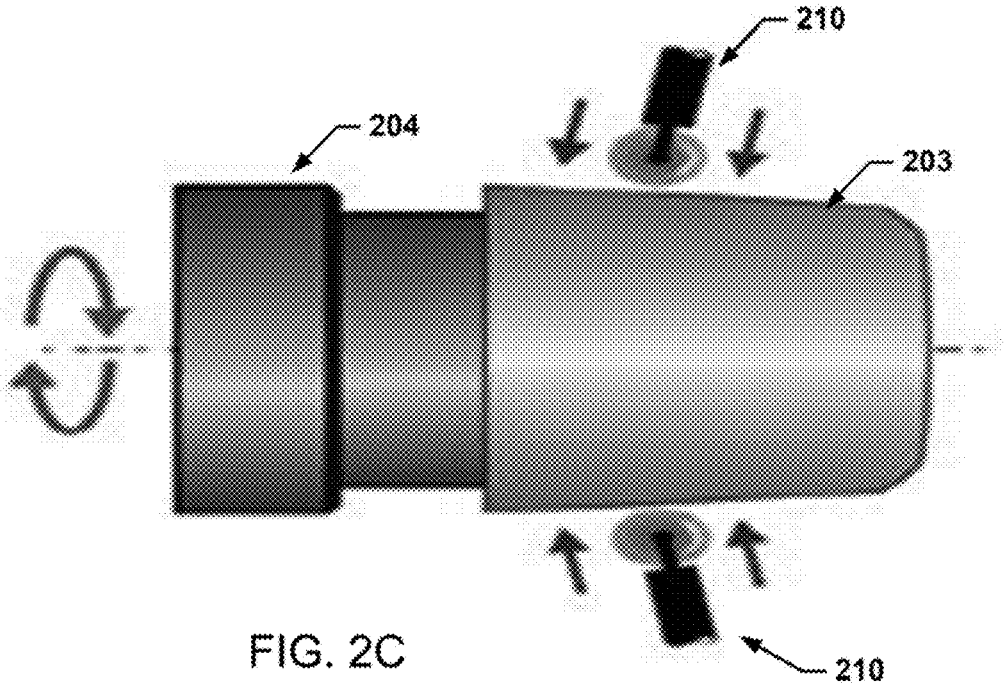
FIG. 2C illustrates forming operations using the tool of FIG. 2A during the embodiment in-situ selective reinforcement method.
Figure 2D:
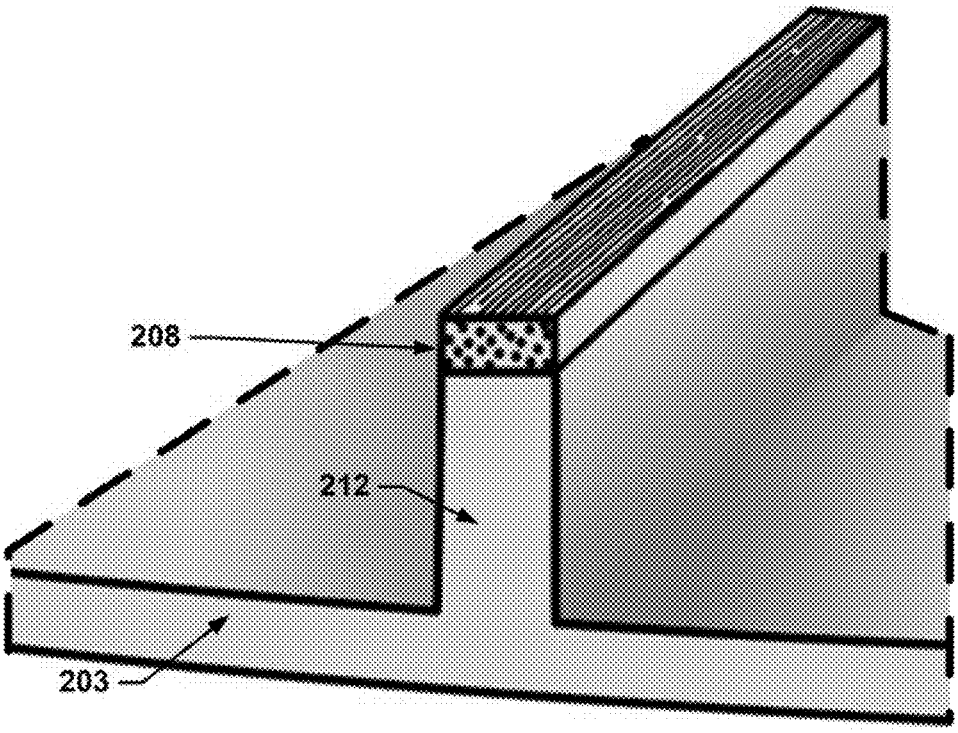
FIG. 2D illustrates a portion of the final metallic structural component incorporating reinforcing material formed by the operations illustrated in FIG. 2C.

In an embodiment illustrated in FIGS. 2A-2D, in-situ selective reinforcement may provide integrally stiffened aluminum alloy cylinders fabricated with a one-step spin/flow forming process. FIG. 2A illustrates a tool 204 and starting material, such as aluminum alloy plate 203. The tool 204 may be a cylindrical mandrel having grooves 206 formed in surface 207 of the tool 204. In a first step of the embodiment process, one or more locations on the tool 204 for forming the aluminum alloy cylinder may be selected for reinforcement. For example, the bottoms of grooves 206 on the cylindrical mandrel may be selected for reinforcement to result in a final aluminum alloy cylinder with reinforced stiffeners. In a second step of the embodiment process, strips of a fiber-reinforced aluminum MMC material 208, such as strips of a fiber-reinforced aluminum MMC tape, may be placed at the selected location on the tool. For example, strips of a fiber-reinforced aluminum MMC material 208, such as strips of a fiber-reinforced aluminum MMC tape, may be placed at the bottom of grooves 206 in a cylindrical mandrel as illustrated in FIG. 2B which shows an exploded portion 201 of the tool 204. In a third step of the embodiment process illustrated in FIG. 2C, the aluminum alloy plate 203 may be preheated then formed over the tool 204, such as a cylindrical mandrel. The aluminum alloy may flow into the tool 204 (for example, the aluminum alloy may flow into the grooves 206 of the cylindrical mandrel) to form the stiffeners integral with the cylinder wall when the tool 204 is rotated and the rollers 210 apply pressure to the aluminum alloy plate 203 pressing it against the tool 204. When the aluminum alloy reaches the selected locations on the tool 204 (for example, the bottom of the grooves in the mandrel) the flow forming pressure may force the aluminum alloy into contact with the fiber-reinforced aluminum MMC material 208, such as strips of a fiber-reinforced aluminum MMC tape, and a metallurgical bond may form between the aluminum alloy and the fiber-reinforced aluminum MMC material 208. The resultant final metallic structural component may be a stiffened aluminum alloy cylinder with the fiber-reinforced aluminum MMC material 208 bonded to the top of each stiffener 212 of the cylinder as illustrated by the portion of the final metallic structural component illustrated in FIG. 2D. The embodiment selective reinforcement may enhance the strength and stiffness of the cylinder and allow for the design of cylinders with reduced weight in comparison to cylinders reinforced by current methods.

The various embodiments may enable the incorporation of MMC reinforcing material into a metallic structure as part of the structure's fabrication process. The various embodiments may not require secondary processing that may affect the structure's mechanical properties. The various embodiments may not require bonding agents that would limit the benefits of the reinforcing material. The various embodiments may add reinforcement to only the specific regions of the structure that need enhanced strength, stiffness, and/or damage tolerance, thereby allowing for more efficient design and the reduction of the structural weight in comparison to current reinforcement processes.

The various embodiments may be applicable to the fabrication of lightweight pressurized storage tanks and/or lightweight cryogenic propellant tanks.

EXPERIMENTAL RESULTS

Experiments were conducted to assess the feasibility of selectively reinforcing aluminum structural components with fiber-reinforced metallic tapes. Exploratory processing experiments were conducted using vacuum hot press techniques to directly embed a commercially-available reinforcing material into aluminum and aluminum-lithium alloy plates. The experiments analyzed bonding between the reinforcing material and the base material. The integrity of these bonds was evaluated using microstructural analysis and three-point bend testing. In addition, in-situ bonding methods that can incorporate the reinforcing materials into structures during near-net-shape fabrication processes were explored.

Two different base plate materials were used for these processing experiments: aluminum alloy 2219-T851 plate with thickness of 0.25 inch and aluminum-lithium alloy 2195-T8 with thickness of 0.190 inch. Base plates with thickness ranging from 0.18 inch to 0.25 inch were machined from these plates.

The reinforcing material was MetPreg™ tape, a commercially-available fiber-reinforced aluminum material. This tape includes a commercially-pure aluminum (Al-1100) matrix reinforced with 50 volume percent continuous Nextel™ 610 alumina fibers. The tape thickness was nominally 0.018 inch and the width was either 0.375 inch or 0.48 inch. In addition to this MetPreg™ tape, two more variants of the tape were examined. One variant had the same fiber volume fraction but used an aluminum alloy matrix with 2 weight percent copper (Al-2Cu) instead of Al-1100. This tape was 0.018-inch thick by 0.375-inch wide. The other variant used the Al-1100 matrix, but the tape thickness was increased to 0.180 inch. This thicker tape had a nominal width of 0.45 inch.

In the experiments, a 190-ton vacuum hot press with temperature capability of 2300° F. was used to consolidate the selectively-reinforced panels. Base plates were machined to the desired dimensions. Base plate width was in the range of 1 inch to 3 inches. The length varied from 2.75 inches to 6 inches. Some of the base plates had a groove machined into the surface deep enough to accommodate the reinforcing tape. The base plates and reinforcing tapes were chemically cleaned prior to consolidation processing. The base plate and tape stacking sequence was assembled. In some cases, stainless steel dies were used to limit the outward flow of the base plate material during hot pressing. Boron nitride anti-seize compound and molybdenum foils were used to protect the hot press platens and any dies that were used to support the assembly. The hot press chamber was evacuated and heated to the target processing temperature. The platens were engaged to apply the consolidation load to the assembly for the desired length of time. The platens were then disengaged to remove the load and the consolidated panel was allowed to furnace cool.

Three-point bend tests were conducted on specimens machined from some of the consolidated panels to evaluate the mechanical integrity of the bond between the base plate and the reinforcing tape. ASTM Standards D7264 and E85 were used as guides for the tests. However, the specimen dimensions did not meet the dimensional requirements from the standards due to size limitations of the consolidated panels. In the 3-point tests the base of the load fixture was attached to the load cell mounted to the test machine. Specimens were tested using a span of 3 inches. The mid-span load was applied to the specimen using the test machine's hydraulic ram at a constant deflection rate of 0.01 inch/minute. An extensometer was located beneath the specimen to measure deflection at the mid-span location. An automated data acquisition system collected the load and deflection data. Multiple tests were conducted on each specimen at low loads to evaluate the stability of the load deflection behavior for the selectively-reinforced material. Testing was performed with the reinforced surface in either tension or compression. Bending stiffness was defined as the slope of the load-deflection curve and was calculated by linear regression. Eventually, the specimens were loaded to failure to investigate the fracture behavior of the selectively-reinforced material and the integrity of the bond line.

Following static 3-point bend testing at low loads, two of the specimens were selected for fatigue testing. Tests were conducted with a span of 3 inches. The specimens were configured such that the reinforced surface was loaded in tension. An R ratio of 0.1 was used. The target frequency was 5 Hz. During the fatigue test load cycle sequence the initial maximum fatigue load was 50 lbs and the specimen was fatigued for 50,000 cycles. The test was paused and the maximum fatigue load was increased by 10 lbs. The specimen was then fatigued for another 50,000 cycles. The maximum fatigue load was incremented by 10 lbs following each set of 50,000 cycles until the specimen failed. In addition, static bend tests up to the maximum fatigue load were conducted before and after each set of fatigue cycles to determine if the load deflection behavior was affected by fatigue cycling.

Microstructures and test specimen fracture surfaces were analyzed using optical and scanning electron microscopy.

Selectively-Reinforced Al-2219 Experiment Results

Figure 5:
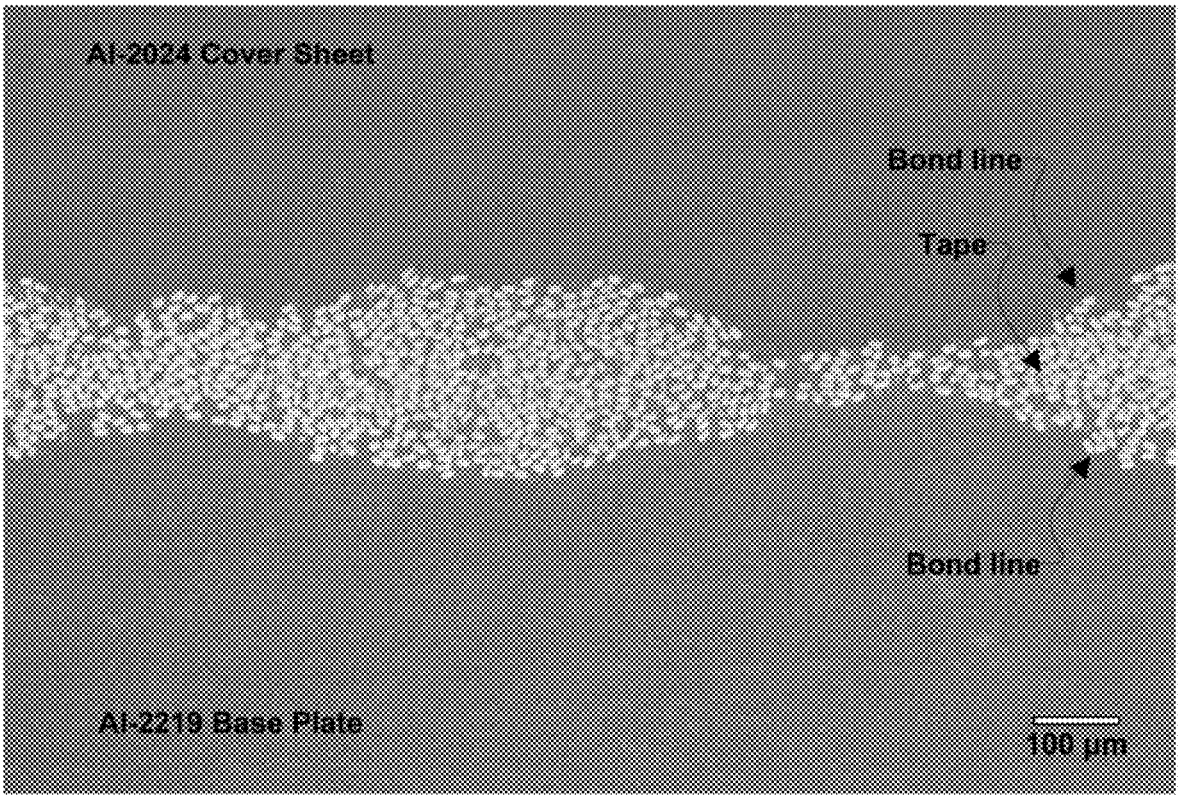
FIG. 5 is a photomicrograph of a selectively-reinforced Al-2219 panel.
Figure 6:
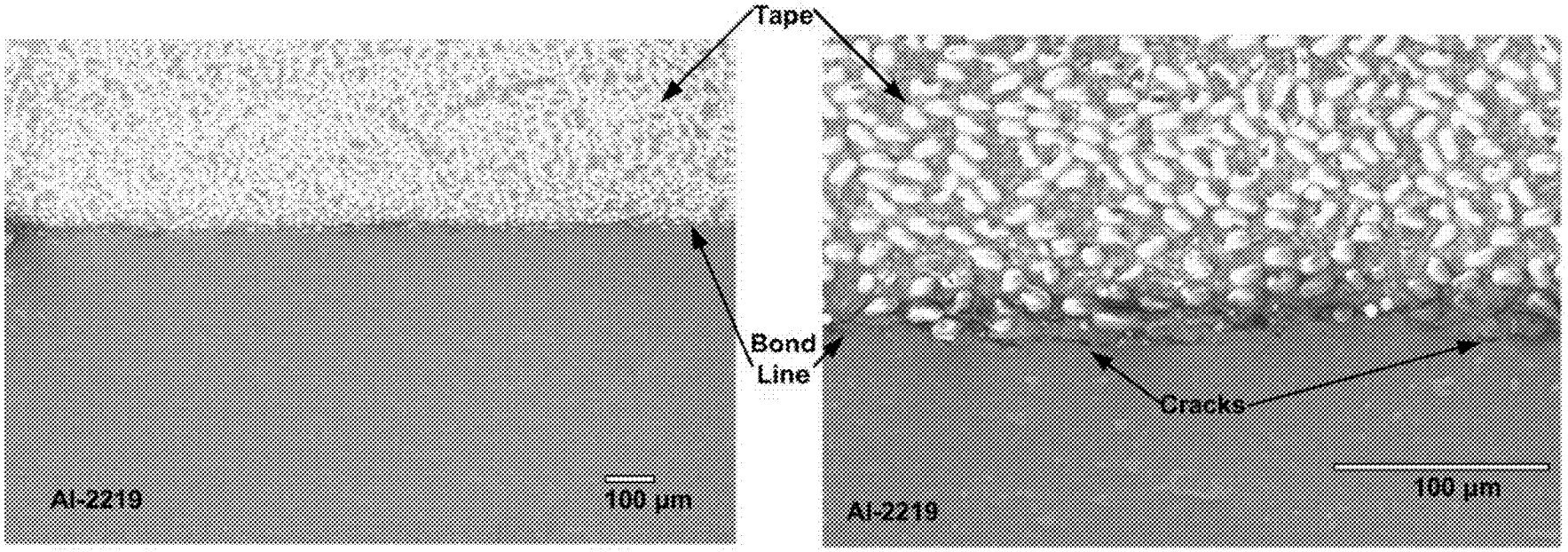
FIG. 6 shows two different magnification photomicrographs of a selectively-reinforced Al-2219 panel.

Experiments were conducted to investigate selective reinforcement of a thin Al-2219 plate. The panel components and processing parameters for the Al-2219 plate experiments are summarized in table 300 illustrated in FIG. 3. The effects of the vacuum hot press parameters on the bond between the base plate and the reinforcing tape were evaluated with microstructural analysis. A 0.48-inch wide by 0.03-inch deep groove was machined into the top surface of a 0.25-inch thick Al-2219 base plate. The MetPreg™ tape with the Al-1100 matrix was inserted in the groove. A 0.050-inch thick sheet of Al-2024 was positioned on top of the assembly to facilitate even distribution of the hot press load over the whole part. Al-2024 sheet was used for this particular experiment because it was readily available in thin sheet form whereas the Al-2219 plate was thicker than desired for a thin cover plate. The overall length and width of the panel assembly were 2.75 inches and 1.0 inch, respectively. The assembly was processed in the vacuum hot press at 930° F. with a pressure of 15 ksi for 1 hour. The processing temperature was very high and thus the materials exhibited a large degree of plastic flow. The hot-pressed panel had a thickness of 0.110 inch. The microstructure of the reinforced region is shown in FIG. 5. A good bond was formed between the reinforcing tape and both the Al-2219 base plate and the Al-2024 cover sheet, but the tape exhibited excessive lateral flow due to the applied pressure at high temperature. A second assembly was hot pressed for one hour at a slightly lower temperature (890° F.) and a much lower pressure (0.35 ksi). This panel (VHP-388) did not have the extreme deformation that was observed in the previous panel. However, due to the low consolidation pressure, the tape did not adhere to the base plate. Subsequent experiments to bond the tape to the Al-2219 surface involved applying the hot press load directly to the tape instead of distributing the load over the whole panel surface. Two pieces of Al-2219 plate were used. A 0.48-inch wide by 0.04-inch deep groove was machined into the surface of the base plate. The top plate had the surface machined down such that a 0.48-inch wide by 0.06-inch tall stub was left on the surface that would fit into the groove on the base plate. The tape with the Al-1100 matrix was pre-placed in the groove and the stub of the top plate was inserted into the groove on top of the tape. The assembly had a gap between the top plate and base plate of approximately 0.04 inch. The overall length and width of the assembly were 6 inches by 2 inches, respectively. The length and width of the tape over which the hot press load was applied were 6 inches by 0.48 inch, respectively. This assembly was processed at 570° F. for 15 minutes at a constant load such that the pressure applied to the surface of the tape was 60 ksi. The materials in the vicinity of the reinforcing tape were well consolidated. A high consolidation pressure was maintained on the reinforcing tape because the gap between the two plates did not close up enough to cause significant load redistribution. The microstructure of the interface region shows some signs of cracking between the tape and the base plate as illustrated in FIG. 6.

Selectively-Reinforced Al-2195 Experiment Results

Experiments were conducted to investigate selective reinforcement of a thin Al-2195 aluminum-lithium alloy plate. The panel components and processing parameters are summarized in table 400 of FIG. 4. All of these experiments had the reinforcing tape pre-placed on the flat surface of the base plate such that the consolidation load was applied directly to the tape. The effect of the vacuum hot press parameters on the bond between the base plate and the reinforcing tape was evaluated with microscopy and 3-point bend testing.

Base plates with thickness of 0.185 inch were machined from a thicker plate of Al-2195-T8. The base plates were 2.5 inches long by 1 inch wide. No grooves were machined into the plates. A strip of the MetPreg™ tape with either the Al-2Cu matrix or the Al-1100 matrix was pre-placed onto the surface. The tape width and thickness was 0.375 inch by 0.018 inch. The plates were processed in the vacuum hot press using the parameters shown in table 400. The processing temperatures were significantly higher than those for which the Al-2219 panels exhibited a good bond with the reinforcement. These higher temperatures were selected to allow plastic deformation in the base plate material such that the tape could be embedded into the plate.

Figure 7:
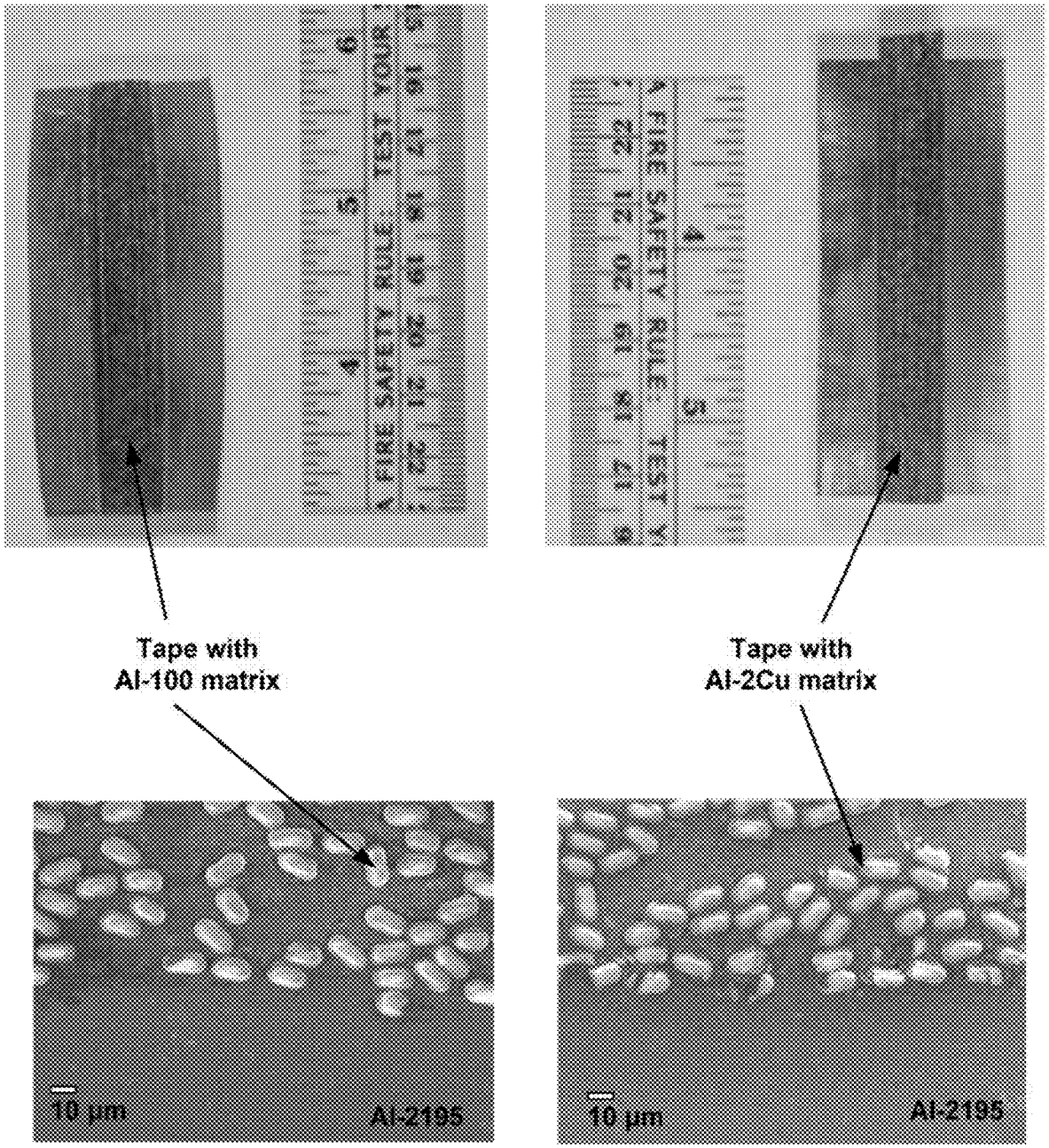
FIG. 7 show side-by-side comparison photographs of consolidated selectively-reinforced Al-2195 panels and microstructures of the tape/base plate interfaces.

FIG. 7 shows photographs of the consolidated panels as well as the microstructure of the interface between the tape and the base plate. The base plate material deformed enough to allow the tape to become embedded into the base plate such that the top surface of the tape was flush with the top surface of the plate. The consolidation pressure decreased after enough deformation occurred to allow the top platen to come into contact with the top surface of the base plate. The microstructures show that the panels were well consolidated with no apparent cracks or defects at the bond lines.

Based on these successful bonding experiments, several more panels were fabricated for 3-point bend testing. Panels were fabricated with either one strip or a stack of two strips of tape pre-placed onto the surface of the Al-2195 base plates. The two strips of wider tape were used to increase the volume fraction of selective reinforcement in the panel. The base plates were nominally 5 inches long by 1 inch wide by 0.17 inch thick (see table 2). Four panels with the Al-2Cu matrix were processed simultaneously at 800° F. and 11 ksi (with respect to the tape surface) for 5 minutes (VHP-412-1, -2, -3, and -4). In addition, four panels with a stack of two strips of tape with Al-1100 matrix were processed simultaneously in a second hot press run using the same parameters (VHP-423-1, -2, -3, and -4).

Seven of the eight panels appeared to be well bonded. One panel with one strip of tape (VHP-412-4) did not exhibit good bonding between the tape and the base plate. The tape fell off after removal of the panel from the hot press. It is likely that the platens did not exert the full force on this specimen and thus the tape did not experience the required bonding pressure. This specimen was used to measure the mass increase associated with adding reinforcing tape to the base plate. The mass of the components of this panel was measured following the tape delamination. The base plate mass was 30.8439 grams while the tape mass was 1.1506 grams. Thus, the single layer of tape increased the mass of the base plate by approximately 4%. This measurement can be used to calculate specific mechanical properties of selectively-reinforced specimens on a mass-normalized basis.

In all cases, the reinforcing tapes were embedded into the base plate such that the top surface of the tape was flush with the top surface of the base plate. The specimen with two layers of tape (VHP-423-1) showed a pronounced bond line between the two pieces of tape. Porosity was observed along the bond line between the two tape layers, which was typical for the specimens produced with two layers of tape.

With the exception of the panel in which the tape was not bonded, all of the panels exhibited significant distortion due to thermal expansion mismatch between the tape and base plate. The coefficient of thermal expansion (CTE) for Al-2195 alloy is approximately 14 μin/in/° F. over the processing temperature range. The MetPreg™ tape has a significantly lower CTE of 4 μin/in/° F. During cool-down from the processing temperature, the tape and base plate constrain each other such that the resultant consolidated panel has the tape in a state of residual compression and the base plate in residual tension.

Selectively-Reinforced Al-2195 Bend Testing Results

Each of the eight Al-2195 panels selectively-reinforced with one and two strips of tape was machined to produce 3-point bend specimens. The ends of the panels were trimmed off to be used for microstructural analysis and the edges were machined to produce specimens that were 4 inches long by 1 inch wide with the embedded tape centered on the top surface of the base plate. Following low-load bend testing, some of the specimens had the edges machined down such that there was no excess base plate on the sides of the specimen. The de-bonded specimen (VHP-412-4) was used as a baseline to evaluate the bending behavior of the unreinforced base plate. This specimen had a shallow groove in the top surface where the tape had been placed.

Three tests were run on specimen VHP-412-3 with one layer of reinforcing tape. The specimen was configured such that the reinforced side of the specimen was loaded in compression. The specimen was loaded to 100 lbs and unloaded back to zero during the three separate tests. The bending behavior was very stable with no hysteresis. The same load-deflection curve was generated during loading and unloading for each test. The bending stiffness was approximately 9400 lb/in.

The specimen was also tested three times with the reinforced side loaded in tension. The loading portion of the load-deflection curve for the first test exhibited a large degree of non-linearity while the curve was linear during unloading. The second and third tests generated linear load-deflection curves during loading and unloading. The bending stiffness calculated from these curves was approximately 9000 lb/in. The nonlinearity during the first loading was most likely a result of base plate yielding due to residual stresses near the interface between the tape and the base plate. The Al-2195 alloy yielded at a relatively low load as the bending load superimposed additional tensile stress onto the residual tensile stress in the base plate. During subsequent tests, the specimen accommodated the 100-lb bending load without yielding due to the work hardening from the first cycle. In the initial set of tests in which the specimen was loaded such that the reinforced side was placed in compression, the load-deflection curve was linear because the residual tensile stress in the base plate allowed it to accommodate higher applied compressive stresses from the bending load without yielding. The specimens reinforced with two strips of tape had similar results.

All of the specimens had nominal width and thickness dimensions of 1.00 inch and 0.17 inch, respectively, and were tested with a 3-inch span. The unreinforced specimen had an average bending stiffness of 8370 lb/in over 6 tests with a tight scatter band. The standard deviation (SD) was 43 lb/in. The three specimens with one layer of reinforcing tape had much greater variability in the stiffness measured from test-to-test as well as from specimen-to-specimen. Two of these specimens (VHP-412-1 and 2) had average bending stiffness values of 8490 lb/in (SD=409 lb/in) and 8360 lb/in (SD=160 lb/in), respectively, which were similar to the stiffness of the unreinforced specimen. Specimen VHP-412-3 had an average bending stiffness of 9410 lb/in (SD=256 lb/in). For this particular specimen, increasing the mass by 4% by adding reinforcing tape resulted in a 12% increase in bending stiffness. Thus, selective reinforcement increased the specific stiffness of the Al-2195 base plate. The specimen with two layers of tape (VHP-423-1) had results similar to those for specimen VHP-412-3 with only one layer of tape. It had a bending stiffness of 9230 lb/in (SD=303 lb/in). Although all of the specimens had the same nominal cross-section dimensions, part of the specimen-to-specimen variation can be attributed to small differences between the measured specimen thickness. The bending stiffness is proportional to the specimen thickness raised to the 3rd power. Thus, small thickness differences can result in significant stiffness differences.

Following multiple low-load bending tests to assess stiffness behavior, two of the specimens with one layer of tape reinforcement were tested to failure. Specimen VHP-412-1 was loaded such that the reinforced side was in tension. The specimen exhibited tensile fracture of the reinforcing tape at a load of 225 lbs. This fracture compromised the load-carrying capability of the specimen and the load decreased rapidly to about 180 lbs. At this point, the base plate was able to carry the load and the load began increasing again. Eventually the test was stopped without further fracture and the specimen was unloaded.

Specimen VHP-412-3, was tested such that the reinforced side was in compression. The specimen exhibited buckling of the tape at 440 lbs. This tape buckling compromised the load-carrying capability of the specimen and the load decreased rapidly to about 300 lbs. At this point, the base plate was able to carry the load and the load began increasing again. Eventually the test was stopped without further fracture and the specimen was unloaded.

In addition, two of the specimens with two layers of tape reinforcement were tested to failure. These specimens had the same failure modes as did the specimens with one layer of tape reinforcement. The specimen loaded with the reinforced side in tension exhibited tensile failure of the tape while the specimen loaded with the reinforced side compression exhibited localized buckling of the tape. Neither specimen showed signs of delamination at the base plate-to-tape interface or the tape-to-tape interface.

Specimen VHP-412-2 with one layer of reinforcing tape and specimen VHP-423-2 with two layers of reinforcing tape were selected for fatigue testing. The edges of the specimens were trimmed off to remove the excess Al-2195 base plate in order to have the bond line between the base plate and reinforcing tape exposed along the entire length of the specimen. Once the specimens were modified, they were renamed VHP-412-2-MOD and VHP-423-2-MOD. The final width of the two specimens was 0.40 inch and 0.35 inch, respectively. The specimens were tested such that the reinforced side was loaded in tension. Several static 3-point bend tests were conducted on the specimens to a maximum load of 50 lbs to establish baseline load-deflection curves prior to fatigue testing.

No change in bending behavior was observed due to fatigue in the load-deflection curves for the two specimens before and after 50,000 fatigue cycles at a maximum fatigue load of 50 lbs. This result was typical for each of the sets of 50,000 fatigue cycles at the incrementally-increased maximum fatigue loads. Table 800 illustrated in FIG. 8 shows the bending stiffness for both specimens measured before and after each set of fatigue cycles. The bending stiffness after each set of fatigue cycles was within 5% of that measured prior to fatigue testing.

Specimen VHP-412-2-MOD with one layer of tape was subjected to 5 sets of 50,000 fatigue cycles at maximum fatigue loads of 50 lbs to 90 lbs in increments of 10 lbs without failure or changes in load-deflection behavior. The specimen was inadvertently overloaded during test setup for the 100-lb maximum fatigue load test. The tape fractured in tension but remained bonded to the Al-2195 base plate.

Specimen VHP-423-2-MOD with two layers of tape was subjected to 8 sets of 50,000 fatigue cycles at maximum fatigue loads of 50 lbs to 120 lbs in increments of 10 lbs without failure or changes in load-deflection behavior. During fatigue testing at a maximum load of 130 lbs, the specimen failed after approximately 13,000 cycles. The outer layer of tape delaminated from the inner layer of tape. This loss of load-carrying capability resulted in overload of the specimen and tensile fracture of the inner tape. The inner tape remained bonded to the base plate.

Selective Reinforcement of Al-2195 Stiffeners Results

An experiment was conducted to simulate the in-situ selective-reinforcement of Al-2195 during near-net-shape processing of integrally-stiffened structure. A stainless steel die was fabricated with a channel that was 0.45 inch wide, and 0.5 inch deep. A 0.180-inch thick strip of custom fabricated MetPreg™ tape was positioned in the bottom of the channel. A 0.7-inch tall block of Al-2195 was placed in the die and hot pressed at 800° F. and 10 ksi pressure for 5 minutes (VHP-444).

Figure 9:
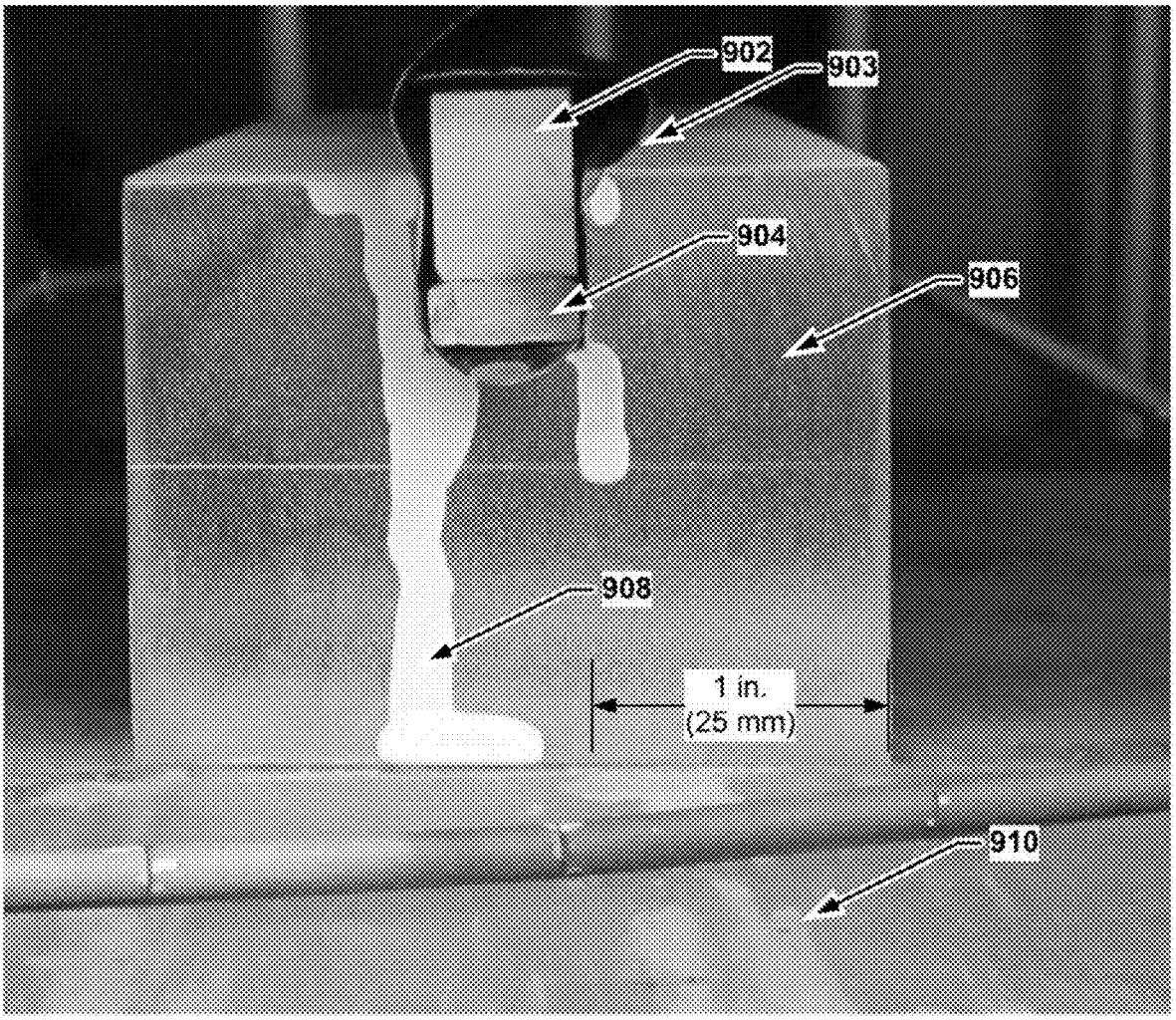
FIG. 9 is a photograph of an assembly for manufacturing a simulated selectively-reinforced stiffener.
Figure 10:
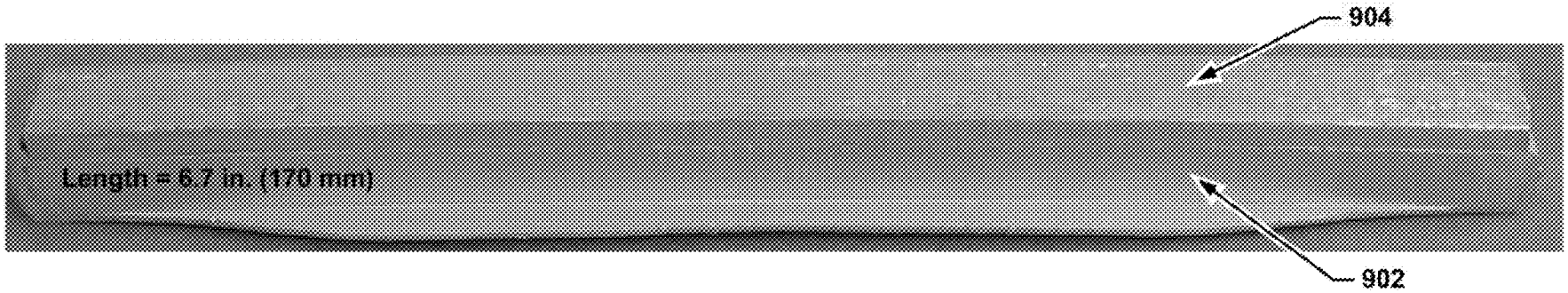
FIG. 10 is a photograph of the finished simulated selectively reinforced stiffener formed by the assembly of FIG. 9.
Figure 11:
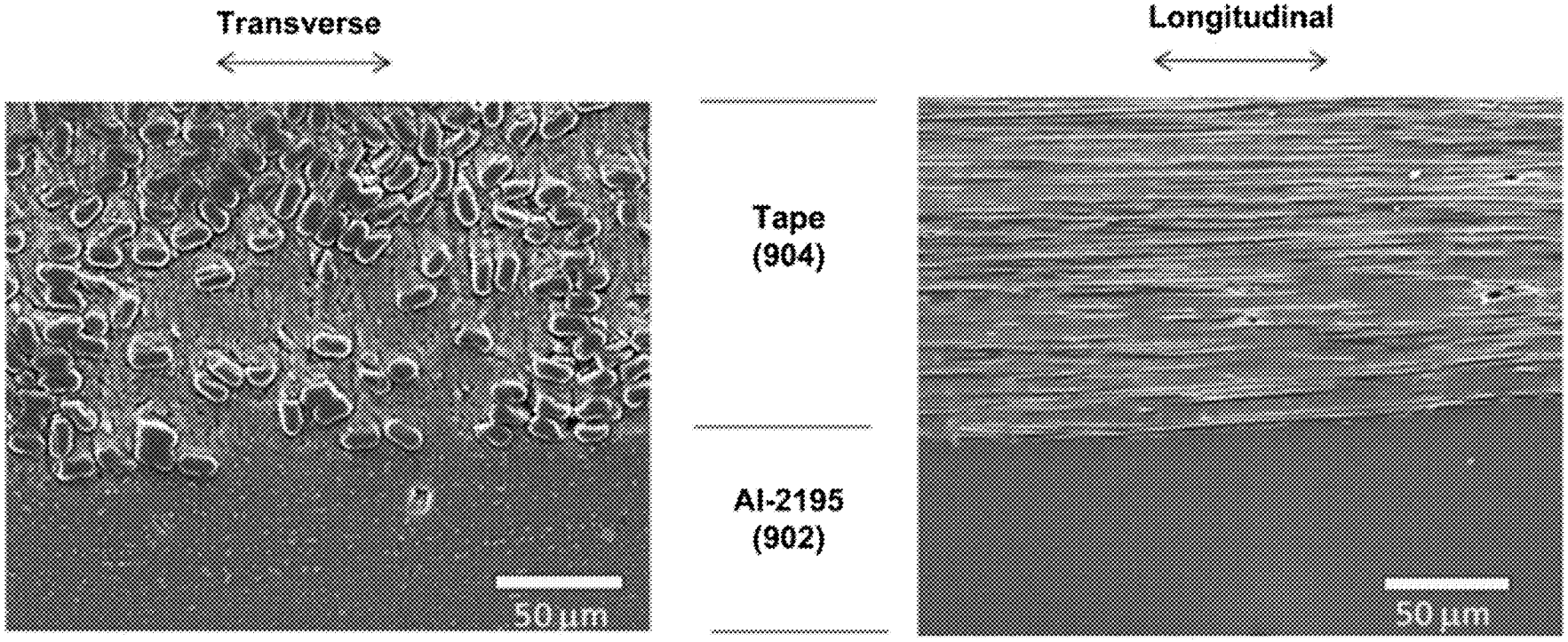
FIG. 11 shows electron photomicrographs of the interface between the tape and the Al-2195 block shown in FIG. 10 in the transverse and longitudinal directions.

FIG. 9 shows a photograph of the specimen including the Al-2195 (Al—Li) block 902 and the tape 904 placed in the die assembly 906 prior to hot press consolidation. The specimen was wrapped in molybdenum foil 903 to protect the die 906 and platens. Release agent 908 is also shown and the die 906 and specimen are shown on the vacuum hot press platen 910. Together, the Al-2915 block 902, molybdenum foil 903, tape 904, and die 906, may constitute the vacuum hot press (VHP) assembly 910. The consolidated specimen is shown in FIG. 10. As shown in FIG. 10, the reinforcing tape 904 appeared to be well bonded to the top of the simulated stiffener 902. The stiffener is bowed due to residual stress. FIG. 11 shows electron photomicrographs of the interface between the tape 904 and the Al-2195 block 902 in the transverse and longitudinal directions. Microstructural analysis indicated a defect-free bond between the tape 904 and the base plate 902. There were no signs of delamination.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. Each range disclosed herein constitutes a disclosure of any point or sub-range lying within the disclosed range.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." As used herein, the term "and/or" includes any and all combinations of one or more of the associated listed items. As also used herein, the term "combinations thereof" includes combinations having at least one of the associated listed items, wherein the combination can further include additional, like non-listed items. Further, the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

Reference throughout the specification to "another embodiment", "an embodiment", "exemplary embodiments", and so forth, means that a particular element (e.g., feature, structure, and/or characteristic) described in connection with the embodiment is included in at least one embodiment described herein, and can or cannot be present in other embodiments. In addition, it is to be understood that the described elements can be combined in any suitable manner in the various embodiments and are not limited to the specific combination in which they are discussed.

What is claimed is:

1. A method of in-situ selective reinforcement, comprising:

selecting at least one location of a final structural component for reinforcement;

placing a metal matrix composite (MMC) material in a forming tool in at least one location of the forming tool corresponding to the at least one location of the final structural component for reinforcement; and forming, from a starting stock material, the final structural component using the forming tool with the MMC material placed in it, wherein the forming includes inducing plastic deformation of the stock material, and wherein the forming comprises a one-step near-net-shape structural forming process that includes spin forming using a spinning mandrel and a series of rollers to shape the final structural component wherein the one-step near-net-shape structural forming process comprises and bonding the MMC material in-situ to a surface of the final structural component.

2. The method of claim 1, wherein the MMC material comprises a ceramic.

3. The method of claim 1, wherein the MMC material comprises one or more of aluminum, an aluminum alloy, alumina, and silicon-carbide.

4. The method of claim 3, wherein the MMC material is reinforced with one or more of fibers, whiskers, or particles.

5. The method of claim 4, wherein the MMC material is in the form of a tape.

6. The method of claim 5, wherein the MMC material is a fiber-reinforced aluminum material including an aluminum Al-1100 alloy matrix reinforced with 50 volume percent continuous alumina fibers.

7. The method of claim 5, wherein the MMC material is an aluminum alloy with a percent weight copper.

8. The method of claim 7, wherein the percent weight copper is 2 percent.

9. The method of claim 5, wherein a thickness of the tape is from 0.018 inches to 0.180 inches.

10. The method of claim 9, wherein a width of the tape is from 0.375 inches to 0.48 inches.

11. The method of claim 1, wherein the starting stock material is an aluminum-lithium alloy.

12. The method of claim 1, the starting stock material comprises aluminum or an aluminum alloy.

13. The method of claim 1, wherein the spinning mandrel comprises a cylindrical mandrel with a plurality of grooves formed on a surface thereof, and wherein the at least one location of the forming tool includes at least one surface of the plurality of grooves.

14. The method of claim 13, wherein:

the MMC material comprises aluminum or an aluminum alloy; and the final structural component comprises an aluminum alloy cylinder having one or more stiffeners with the MMC material bonded to a top of each of the one or more stiffeners.

15. A method of in-situ selective reinforcement, comprising:

selecting at least one location of a final structural component for reinforcement;

placing a metal matrix composite (MMC) material in a forming tool in at least one location of the forming tool corresponding to the selected at least one location of the final structural component for reinforcement, wherein the MMC material comprises aluminum or an aluminum alloy; and forming, from a starting stock material, the final structural component by a one-step near-net-shape structural forming process using the forming tool with the MMC material placed in it, wherein the starting stock material comprises aluminum or an aluminum alloy and the forming includes inducing plastic deformation of the stock material, wherein the forming includes spin forming using a spinning mandrel and a series of rollers to shape the final structural component wherein the one-step near-net-shape structural forming process comprises pressing the rollers to deform the stock material along a length of the spinning mandrel and bonding the MMC material in-situ to a surface of the final structural component.

16. The method of claim 15, wherein:

the MMC material is a tape; and the starting stock material is an aluminum-lithium alloy; and the final structural component is a stiffenered aluminum-lithium alloy cylinder with the MMC material bonded to stiffeners formed integral with a wall of the of the stiffenered aluminum-lithium alloy cylinder.

17. The method of claim 1, wherein the forming is performed at an elevated pressure and includes forming stiffeners integral with a wall of the final structural component when the spinning mandrel is rotated and the starting stock material is pressed against the spinning mandrel.

* * * * *